US005775927A

United States Patent [19]

Wider

[11] Patent Number: 5,775,927

[45] Date of Patent: Jul. 7, 1998

[54] SELF-TERMINATING COAXIAL CONNECTOR

[75] Inventor: Eric S. Wider, East Haven, Conn.

[73] Assignee: Applied Engineering Products, Inc., Conn.

[21] Appl. No.: 774,656

[22] Filed: Dec. 30, 1996

[51] Int. Cl.[6] ..... H01R 29/00

[52] U.S. Cl. ..... 439/188; 439/944

[58] Field of Search ..... 439/578, 579, 439/580, 581, 582, 583, 584, 585, 63, 188, 944

[56] References Cited

U.S. PATENT DOCUMENTS

| | | | |
|---|---|---|---|
| 2,914,740 | 11/1959 | Blonder . | |
| 3,275,970 | 9/1966 | Johanson et al. . | |
| 3,587,033 | 6/1971 | Brorein et al. . | |
| 4,099,825 | 7/1978 | Jackson . | |
| 4,660,921 | 4/1987 | Hauver | 439/578 |
| 4,892,491 | 1/1990 | Budano, II et al. . | |
| 4,915,651 | 4/1990 | Bout . | |
| 4,941,846 | 7/1990 | Guimond et al. . | |
| 5,383,790 | 1/1995 | Kerek et al. . | |
| 5,417,588 | 5/1995 | Olson et al. . | |

*Primary Examiner*—Neil Abrams
*Assistant Examiner*—Yong Ki Kim
*Attorney, Agent, or Firm*—Anthony J. Casella; Gerald E. Hespos; Ludomir A. Budzyn

[57] ABSTRACT

A coaxial connector is provided with front and rear center contacts slidably engaged with one another and moveable from a first relative position where the front contact engages the rear contact and a second position where the front contact is spaced axially from the rear contact. A spring is disposed between the front and rear contacts and is operative to urge the front contact forwardly and out of engagement with the rear contact. A resistor is disposed in permanent engagement with the rear contact. Unmating of the coaxial connector causes the front contact to move forwardly under the action of the spring and out of engagement with the rear contact. This leaves the rear contact in communication with the resistor which functions to terminate the signal generated to the rear contact.

10 Claims, 5 Drawing Sheets

SELF-TERMINATING COAXIAL CONNECTOR

BACKGROUND OF THE INVENTION

1. Field of the Invention

The subject invention relates to a coaxial connector, and particularly to a connector that will automatically resistively terminate in the system impedance when the connector is unmated.

2. Description of the Prior Art

Coaxial connectors are used to connect a signal generating apparatus to a signal receiving apparatus. Prior art coaxial connectors include a center conductor or contact, an outer conductor or body and an insulator therebetween. The size, shape and arrangement of these various components can vary significantly. For example, some coaxial connectors have both their center and outer conductors axially aligned with one another along the respective lengths of the connectors. Other mateable pairs of coaxial connectors comprise at least one connector that extends through a right angle. Some, coaxial connectors are mounted directly to the signal generating or signal receiving apparatus. Other coaxial connectors are mounted to a coaxial cable which, in turn, extends to the apparatus.

Some coaxial connectors are constructed for easy push-pull mating and unmating. Others are mated with a threaded coupling nut. The unmating of the connectors may be carried out to permit a signal receiver to be replaced, repaired or upgraded. The unmating of a pair of coaxial connectors for any of these purposes does not terminate the signal generated from the transmitter. Thus, signals will continue to be generated through the center conductor leading from the signal transmitter. This continuous flow of signals can create cross-talk that would effectively degrade signals being carried by nearby lines. Additionally, the signals can be reflected back through the conductor and can damage the transmitter. To avoid these potential problems, it is common to shut off the signal transmitter before unmating the coaxial connectors. This approach avoids any potential for damage to the transmitter and similarly avoids cross-talk. However, the success of this procedure is dependent entirely upon remembering to shut off the transmitter. Additionally, many coaxial connectors are used in high vibration environments and/or environments where contact by technicians is possible. Thus, an inadvertent unmating may occur and can cause the above-referenced damage to the transmitter and/or signal cross-talk to nearby apparatus. Additionally, it often is necessary to unmate only one connector on a transmitter having a plurality of signal outputs. Turning the entire transmitter off therefore unnecessarily interrupts signals from the output jacks that are not being unmated.

The prior art also includes coaxial connectors that are not mounted to a cable or apparatus, but rather have resistors therein. These prior art connectors may be mated with the unmated connector on a signal transmitter to effectively terminate the signal being transmitted. Prior art connectors of this type at least theoretically solve some of the problems referred to above. However, these prior art connectors with resistors therein still require a signal transmitter to be shut off while a pair of coaxial connectors is being unmated and until the connector with the resistor therein is mated to the transmitter. Prior art connectors with resistors therein also do not help in situations where an accidental unmating occurs. Additionally, a separate inventory of these coaxial connectors with resistors must be maintained, and technicians must be relied upon to use these connectors properly.

In view of the above, it is an object of the subject invention to provide a coaxial connector that avoids transmitter damage and signal cross-talk when the connector is in an unmated condition.

It is another object of the subject invention to provide a coaxial connector for a signal transmitter that does not require the transmitter to be turned off prior to unmating the connector.

Another object of the subject invention is to provide a coaxial connector that does not require a separate inventory of connectors having resistors therein.

Yet another object of the subject invention is to provide a self-terminating coaxial connector.

SUMMARY OF THE INVENTION

The subject invention is directed to a coaxial connector for use with a signal transmitter. The coaxial connector includes a center conductor or contact and an outer conductor or body conductor. The contact includes a rear end for substantially permanent connection to a signal carrying line, coaxial cable, or adaptor with a connector on both ends. The body also includes a rear end for substantially permanent connection to a ground. The contact and the body further include front ends that are configured for mating and unmating with another coaxial connector.

The contact of the subject coaxial connector is a contact assembly with front and rear contacts that are moveable relative to one another. In particular, the front and rear contacts may be moved into a signal transmitting position where the front and rear contacts engage one another and permit efficient transmission of a signal therebetween. The front and rear contacts also may be moved into a signal interrupting position where the respective front and rear contacts do not engage and do not transmit a signal therebetween.

The contact assembly of the subject coaxial connector may further include biasing means for urging the front and rear contacts of the contact assembly toward the signal interrupting position. For example, the biasing means may include a spring disposed between the front and rear contacts. The spring may be disposed to urge the front contact of the assembly away from the rear contact and into the position where signal transmission is interrupted.

The coaxial connector further includes a resistor connected to the rear contact. The resistor is effectively bypassed when the front and rear contacts of the contact assembly are engaged with one another. However, the resistor functions to terminate the signal transmission when the front and rear contacts of the contact assembly are not engaged.

The contact assembly may further include shorting portions for shorting electrical engagement with the body when the front and rear contacts of the contact assembly are disengaged. For example, the shorting portions may include at least one resiliently deflectable flange projecting outwardly from a movable portion of the contact assembly and configured for engagement with the body.

In use forces generated during mating will urge the front contact of the contact assembly against the forces exerted by the biasing means and into engagement with the rear contact of the contact assembly. This engagement between the front and rear contacts of the contact assembly will bypass the resistor and permit efficient signal transmission through the contact assembly and into the center conductor or contact of the coaxial connector mated therewith. When the coaxial connectors are unmated, the biasing means between the front and rear contacts will urge the front contact away from and out of engagement with the rear contact of the contact assembly. Thus, the resistor will immediately and automatically function to terminate the signals generated by the transmitter. It is therefore unnecessary to shut off the transmitter or to utilize a separate coaxial connector with a resistor therein.

DETAILED DESCRIPTION OF THE PREFERRED EMBODIMENT

Figure 1:
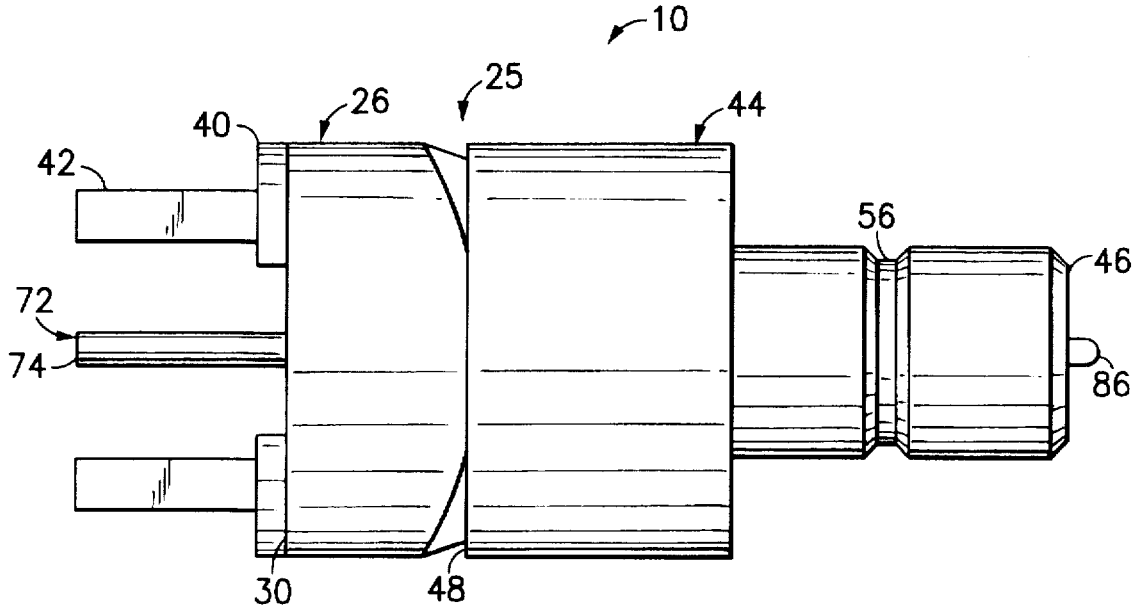
FIG. 1 is a side elevational view of a self-terminating coaxial connector in accordance with the subject invention.
Figure 2:
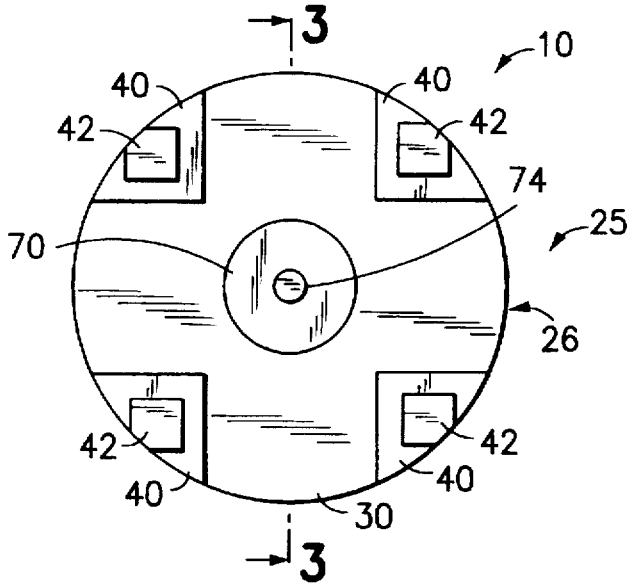
FIG. 2 is an end elevational view of the connector shown in FIG. 1.
Figure 3:
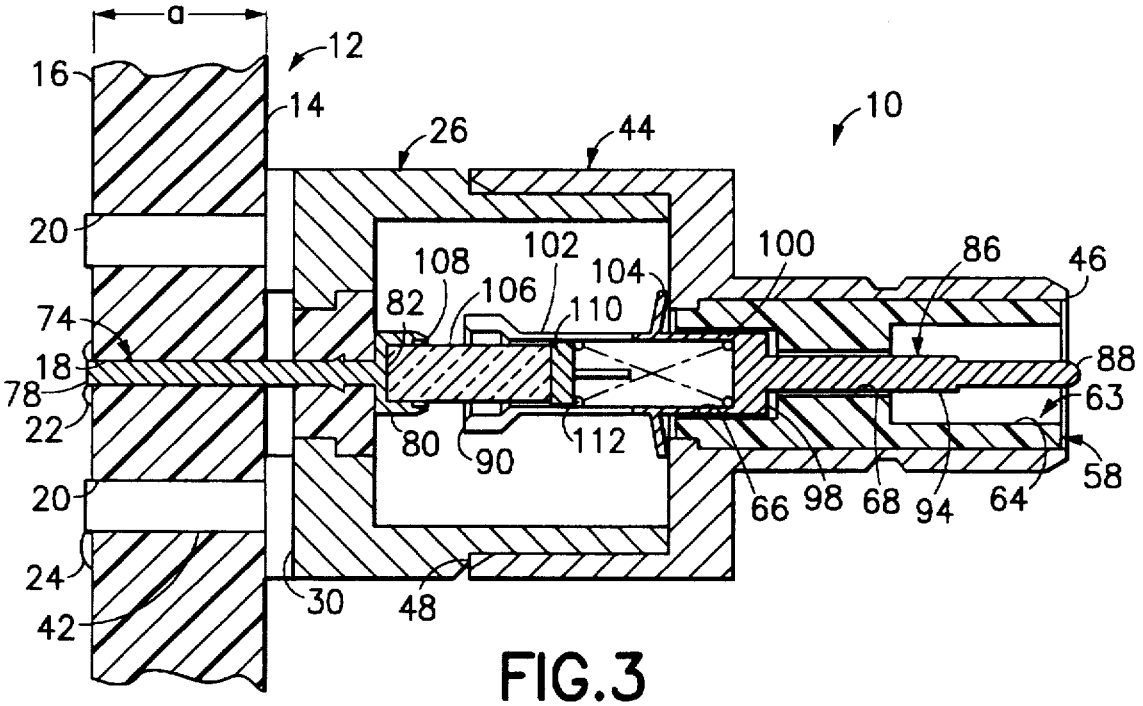
FIG. 3 is a cross-sectional view taken along line 3—3 in FIG. 2.

A coaxial connector in accordance with the subject invention is identified generally by the numeral 10 in FIGS. 1–3. The coaxial connector 10 is mounted to a printed circuit board 12 of a signal transmitter. The circuit board 12 includes opposed front and rear faces 14 and 16 defining a thickness "a" for the circuit board 12. A center aperture 18 extends entirely through the circuit board 12 from the front face 14 to the rear face 16 thereof. Additionally, four outer apertures 20 extend through the circuit board 12 from the front face 14 to the rear face 16 at locations equally spaced from the center aperture 18 and spaced approximately 90° from one another. The rear face 16 is further provided with conductive traces 22, 24 thereon. The conductive trace 22 extends from regions adjacent the center aperture 18 to a signal source in the transmitter to which the circuit board 12 is mounted. Similarly, the conductive trace 24 extends from portions of the rear face 16 of the circuit board 12 adjacent an aperture 20 to a ground in the transmitter to which the circuit board 12 is mounted.

Figure 4:
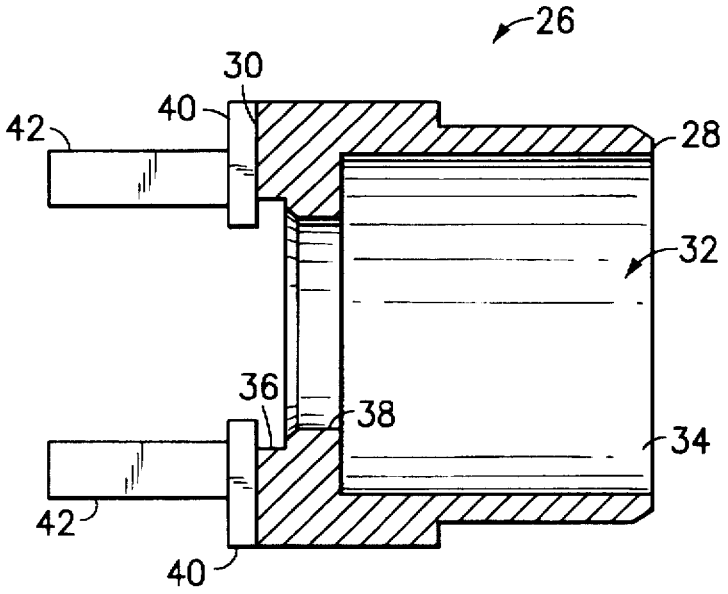
FIG. 4 is a longitudinal cross-sectional view of the rear body of the coaxial connector.

The connector 10 includes a body assembly 25 which is formed from an electrically conductive material such as a brass alloy. The body assembly 25 includes a generally tubular rear body 26 with a widely opened front end 28, a partly closed rear end 30 and a stepped passage 32 extending therebetween as shown most clearly in FIG. 4. The stepped passage 32 includes a large diameter front portion 34 extending rearwardly from the front end 28 and a small diameter rear portion 36 extending forwardly from the rear end 30. An intermediate diameter portion 38 extends between the front and rear portions 34 and 36 respectively.

The rear end 30 of the rear body 26 is further characterized by four board mounting standoffs 40 projecting a short distance from the rear end 30 and spaced approximately 90° from one another. The board mounting standoffs 40 define surface areas that are greater than the cross-sectional areas of the outer apertures 20 through the circuit board 12. The rear body 26 further includes a plurality of legs 42 projecting unitarily from the respective standoffs 40 a distance approximately equal to the thickness "a" of the circuit board 12. The respective legs 42 define cross-sectional dimensions and shapes for slidable insertion into the outer apertures 20. Thus, the legs 42 can be soldered or otherwise connected to one of the conductive traces 24 on the circuit board 12, to connect at least one leg 42 and the entire rear body 26 to ground.

Figure 5:
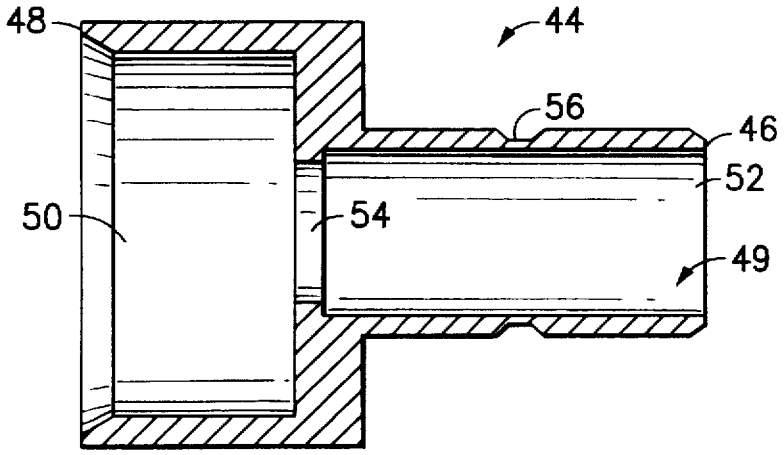
FIG. 5 is longitudinal cross-sectional view of the front body of the coaxial connector.

The body assembly 25 of the coaxial connector 10 further includes a generally tubular front body 44 with opposed front and rear ends 46 and 48 respectively and a stepped passage 49 extending therebetween as shown in FIG. 5. The stepped passage 49 includes a large diameter rear portion 50 extending forwardly from the rear end 48 and defining an inside diameter equal to or slightly less than the outside diameter of portions of the rear body 26 adjacent the front end 28 thereof. Thus, the front end 28 of the rear body 26 can be force fit into the rear portion 50 of the stepped passage 49 extending forwardly from the rear end 48 of the front body 44 to provide a very secure interference fit. This interengagement of the rear body 26 and the front body 44 can be facilitated by a chamfered entry to the large diameter portion 50 of the stepped passage 49 in the front body 44 and by a corresponding chamfer on the front end 28 of the rear body 26.

The passage 49 in the front body 44 of the coaxial connector 10 further includes an intermediate diameter front portion 52 extending rearwardly into the front end 46. A small diameter intermediate portion 54 of the passage 49 extends between and connects the rear portion 50 and the front portion 52. Outer circumferential portions of the front body 44 adjacent the front end 46 include an outer chamfer for facilitating mating with another coaxial connector. Additionally, outer circumferential surface regions of the front body 44 spaced rearwardly from the front end 46 include an annular grove 56 for releasably capturing a locking detent on a mating coaxial connector.

Figure 6:
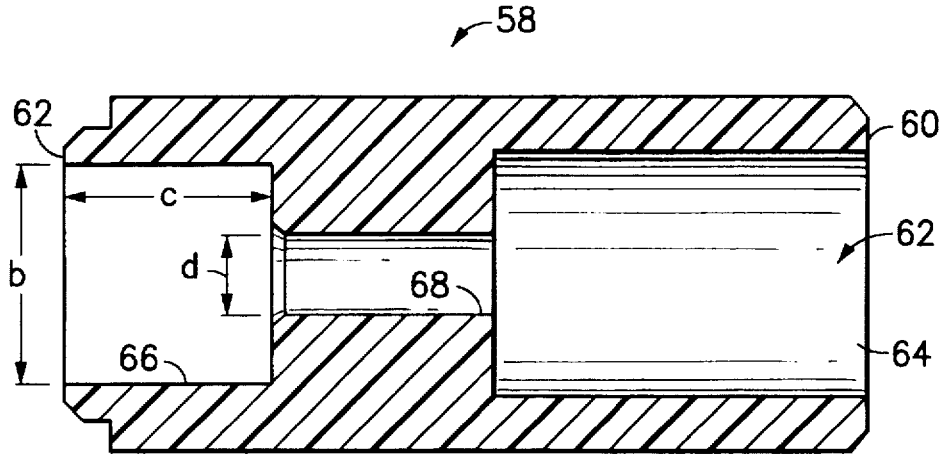
FIG. 6 is a longitudinal cross-sectional view of the front insulator of the coaxial connector.

The coaxial connector 10 further includes a front insulator 58 with front and rear ends 60 and 62 as shown in FIG. 6. The front insulator 58 has a stepped outer circumferential surface dimensioned and configured for secure interference fit in the intermediate diameter front portion 52 of the front body 44 and in the small diameter intermediate portion 54 adjacent thereto. The front insulator 58 further includes a stepped passage 63 extending entirely therethrough. The stepped passage 63 includes a front portion 64 extending rearwardly into the front end 60 and dimensioned to receive portions of a mating coaxial connector. A rear portion 66 the passage 63 extends forwardly from the rear end 62 toward the front portion 64. The rear portion 62 of the passage 63 defines a diameter "b" and a length "c". The passage 63 through the front insulator 58 further includes an intermediate portion 68 extending axially between the front and rear portions 64 and 66. The intermediate portion 68 of the passage 63 defines a diameter "d".

Figure 7:
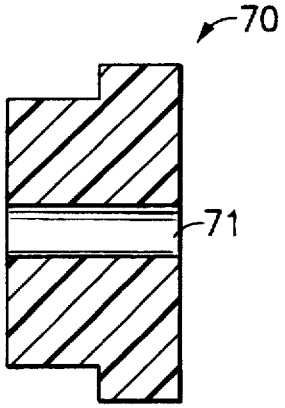
FIG. 7 is a longitudinal cross-sectional view of the rear insulator of the coaxial connector.

The coaxial connector 10 further includes a rear insulator 70 as shown in FIG. 7. The rear insulator has a stepped outside diameter dimensioned for interference fit in the small and intermediate diameter portions 36 and 38 of the passage 32 in the rear body 26. A passage 71 extends axially through the rear insulator 70.

Figure 8:
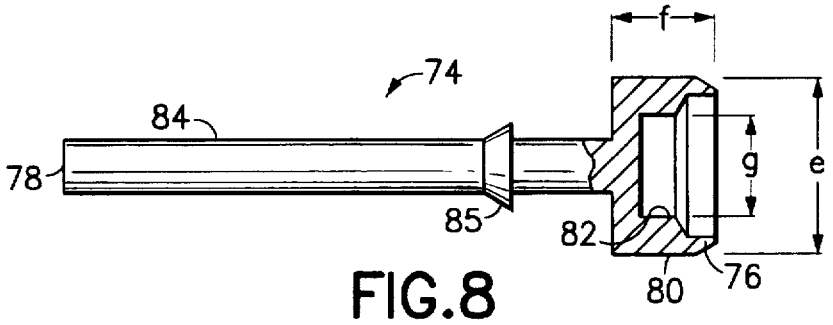
FIG. 8 is a cross-sectional view of the rear contact of the coaxial connector.

The connector 10 further includes a contact assembly 72. The contact assembly 72 includes a rear contact 74 secured concentrically in the passage 71 through the rear insulator 70. More particularly, as shown in FIG. 8, the rear contact 74 includes opposed front and rear ends 76 and 78. Portions of the rear contact 74 adjacent the front end 76 define a receptacle 80 having a cylindrical outer surface of diameter "e" extending a length "f" from the front end 76 of the rear contact 74. Portions of the outer surface adjacent the front end 76 are chamfered. The receptacle 80 of the rear contact 74 further includes a stepped cylindrical recess 82 extending rearwardly from the front end 76. Deepest portions of the recess 82 define a diameter "g". However, portions of the recess 82 immediately adjacent the front end 76 of the rear contact 74 define a larger diameter for receiving solder as explained further herein.

The rear contact 74 includes a small diameter tail 84 extending rearwardly from the receptacle 80 to the rear end 78 of the rear contact 74. Barbs 85 project outwardly from a location on the rear contact 74 for secure engagement in the rear insulator 70. Portions of the rear contact 74 extending rearwardly from the receptacle 80 define a length efficient to position the rear end 78 substantially in registration with the rear ends of the legs 42 of the rear body 26. Thus, the rear end 78 of the rear contact 74 can be soldered to the conductive trace 22 on the rear face 16 of the circuit board 12 for delivering a signal to contact assembly 72.

Figure 9:
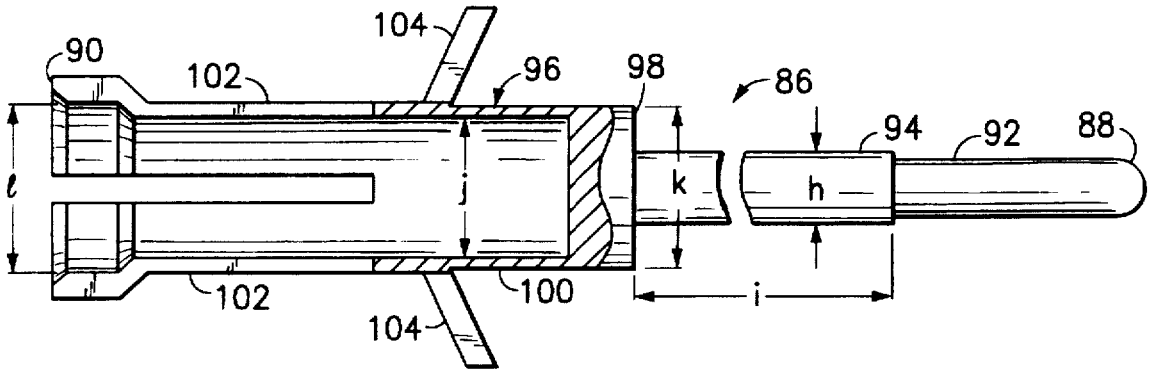
FIG. 9 is a side elevational view, partly in section, showing the front contact of the coaxial connector.
Figure 10:
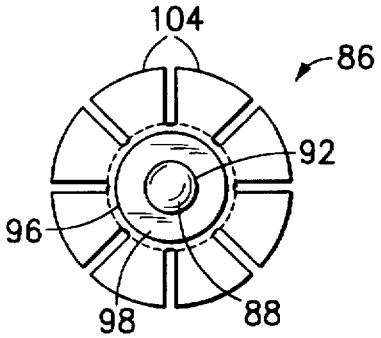
FIG. 10 is an end elevational view of the front contact.

The contact assembly 72 of the coaxial connector 10 further includes a front contact 86 as shown in FIGS. 9 and 10. The front contact 86 includes a front end 88 disposed in the front portion 64 of the passage 63 through the front insulator 58. Portions of the front contact 86 adjacent the front end 88 define a short cylindrical pin 92 that can be securely but releasably engaged by the center contact of a mating coaxial connector. The front contact 86 further includes a rear end 90 disposed in the front portion 34 of the passage 32 through the rear body 26.

A cylindrical intermediate section 94 of the front contact 86 extends rearwardly from the pin 92 and defines a diameter "h" which is less than the diameter "d" of the central portion 68 of the passage 63 through the front insulator 58. The intermediate section 94 defines a length "i" which is greater than the length of the intermediate portion 68 of the passage 63 through the front insulator 60. With these dimensions, the intermediate section 94 of the front contact 86 can slide axially through intermediate portion 68 of the passage 63 through the front insulator 58.

The front contact 86 defines an elongate rear receptacle 96. The receptacle 96 is defined by the transverse wall 98 at the rear end of the intermediate section 94. A cylindrical wall 100 extends rearwardly from the transverse wall 98 and defines an inside diameter "j" and an outside diameter "k". The outside diameter "k" is less than the inside diameter "b" of the rear portion 66 of the passage 63 through the front insulator 58. The rear receptacle 96 further includes a plurality of resiliently deflectable fingers 102 projecting rearwardly from the cylindrical wall 100 toward the rear end 90 of the front contact 86. The rear ends of the respective fingers 102 are flared outwardly to define a major inside diameter "l". The extreme rear end of the fingers 102 include a chamfer leading into inner surfaces of the fingers 102. The inside diameter "l" is slightly less than the outside diameter of the receptacle 80 of the rear contact 74. Thus, the fingers 102 must be biased outwardly slightly to receive the receptacle 80 of the rear contact 74 therebetween. This outward biasing is facilitated by the chamfer at the rear end of the fingers 102 and the tapering at the front end 76 of the rear contact 74.

The front contact 86 further includes a plurality of resiliently deflectable flanges 104 projecting outwardly and forwardly from the cylindrical wall 100 thereof. The flanges 104 function as a wave washer for resiliently engaging the front body 44.

Returning to FIG. 3, the coaxial connector 10 further includes a generally cylindrical resistor 106 received within the recess 82 of the receptacle 80 at the front end 76 of the rear contact 74. The resistor 106 is secured by solder 108 deposited at the large diameter portion adjacent the recess 82 in the receptacle 80 after positioning the resistor 106 in the recess 82. The resistor 106 projects from the rear contact 74 forwardly and into the generally cylindrical area bounded by the fingers 102 of the front contact 86. The resistor 106 defines an outside diameter considerably less than the inside diameter "j" defined within the rear end 90 of the front contact 86. Consequently slidable telescoped movement of the front contact 86 relative the resistor 106 is substantially unimpeded by the resistor 106.

A spring base 110 is disposed adjacent the forward end of the resistor 106 and within the area bounded by the cylindrical wall 100 and the spring fingers 102. A coil spring 112 extends between the spring base 110 and the transverse wall 98 of the front contact 86. The coil spring 112 is operative to urge the front contact 86 forwardly relative to the rear contact 74 and relative to the front and rear bodies 44 and 26 respectively.

The unmated coaxial connector 10 assumes the relative disposition shown in FIG. 3. In particular, forces exerted by the coil spring 112 urge the front contact 86 forwardly relative to the rear contact 74 and relative to both the front body 44 and the rear body 26. More particularly, the coil spring 112 causes a cylindrical contact pin 92 to move forwardly within the front portion 64 of the passage 63 in the front insulator 58 and similarly causes the intermediate section 94 of the front contact 86 to move forwardly within the intermediate portion 68 of the passage 63 through the front insulator 58. Simultaneously, the rear receptacle 96 of the front contact 96 moves forwardly within the rear portion 66 of the passage 63 through the front insulator 58. This forward movement of the front contact 86 causes the deflectable fingers 102 of the front contact 86 to separate from the rear contact 74 as shown in FIG. 3. Thus, signals transmitted through the rear contact 74 will not be transmitted to the front contact 86. Rather, signals generated through the rear contact 74 will be directed to the resistor 106 and will effectively be prevented from continuous flow out of the unmated connector 10. Simultaneously, the outwardly and forwardly extending deflectable flanges 104 will be urged by the spring 112 into secure electrical contact with the front body 44 adjacent the stepped passage 49 therethrough to cause an immediate automatic shorting.

Figure 11:
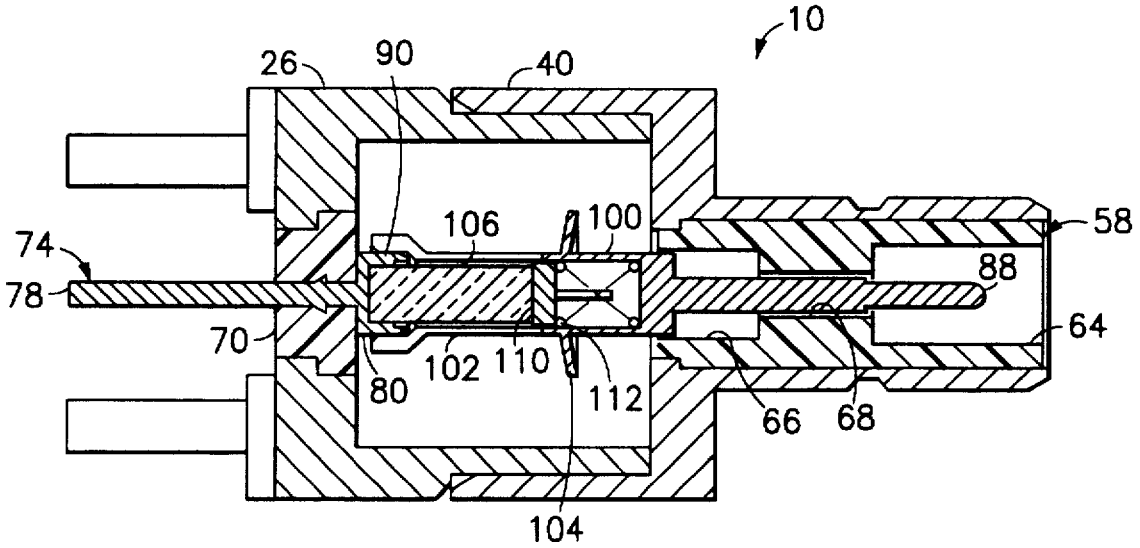
FIG. 11 is a cross-sectional view similar to FIG. 3, but showing the front contact in the connect mode that would occur after mating.

During mating, the contact of the mateable connector is urged into the front portion 64 of the passage 63 through the front insulator 58. The center contact of the mating connector is urged into engagement with the pin 92 at the front end 88 of the front contact 86 and urges the front contact 86 rearwardly against the biasing forces exerted by the coil spring 112. Sufficient rearward movement of the front contact 86 against the biasing forces of the spring 112 causes the deflectable fingers 102 to telescope over the receptacle 80 at the front end 76 of the rear contact 74 as shown in FIG. 11. This engagement of the fingers 102 with the receptacle 80 of the rear contact 74 will achieve electrically conductive engagement between the rear contact 74 and the front contact 86 and will effectively bypass the resistor 106.

A subsequent unmating of the coaxially connector 10 will reduce the biasing forces on the front contact 86 and will enable the coil spring 102 to urge the front contact 86 forwardly relative to the rear contact 74. As a result, the spring flanges 104 will be urged into shorting contact with the front body 44 and the fingers 102 will be immediately and automatically separated from the receptacle 80 of the rear contact 74 as shown in FIG. 3. Hence, signals generated through rear contact 74 will communicate only with the resistor 106 which effectively functions to prevent the signals from being continually transmitted from the connector 10.

While the invention has been described with respect to a preferred embodiment, it is apparent that various changes can be made without departing from the scope of the invention as defined by the appended claims. In particular, the prior art shows coaxial connectors taking many different forms, including right angle connectors, connectors mechanically and electrically joined to structures other than circuit boards and connectors in which structures for engaging a mating connector differ from those shown herein. The self-terminating features described and illustrated above may be incorporated into such other connectors. These and other variations will be apparent to persons skilled in the art after having reviewed the subject disclosure.

What is claimed is:

1. A self-terminating coaxial connector comprising: a generally tubular body; a contact assembly disposed concentrically within said body, said contact assembly comprising a rear contact for secure connection to a signal carrier and a front contact for releasable connection to a center contact of a mating coaxial connection, said front contact being moveable axially relative to said rear contact and relative to said body between a first position where said front and rear contacts are electrically engaged with one another and a second position where said front and rear contacts are spaced from one another; biasing means for urging said front and rear contacts towards said second position relative to one another; and a resistor connected to said rear contact for terminating signals transmitted to said rear contact when said front and rear contacts are in said second position.

2. The connector of claim 1, further comprising insulating material between said body and contact assembly for preventing contact therebetween when said front and rear contacts of said inner conductor are in said first position.

3. The coaxial connector of claim 2, wherein said front contact further comprises shorting means for electrically contacting said body when said front and rear contacts are in said second position.

4. The coaxial connector of claim 2, wherein said front contact is moveable relative to said rear contact in response to forces generated during mating with a mateable coaxial connector, and wherein said biasing means is operative for urging said front contact away from said rear contact and into said second position upon unmating of the mateable connector.

5. The coaxial connector of claim 2, wherein said body includes releasable locking means for holding a mateable connector in a position for maintaining said front and rear contacts in said first position.

6. The coaxial connector of claim 1, wherein the rear contact includes a front end having a resistor receptacle therein, and wherein the front contact includes a rear end having an opening dimensioned for telescoped engagement over the receptacle of the rear contact when said front and rear contacts are in said first position.

7. The coaxial connector of claim 6, wherein the rear end of the front contact comprises a plurality of resiliently deflectable spring fingers dimensioned and disposed relative to one another for resiliently gripping the front end of the rear contact.

8. The coaxial connector of claim 7, wherein the rear end of the front contact further comprises a spring receptacle therein for trapping the biasing means between the front and rear contacts.

9. The coaxial connector of claim 8, wherein the biasing means is a coil spring.

10. The coaxial connector of claim 9, further comprising a spring base intermediate said resistor and said biasing means and within the open rear end of the front contact.

* * * * *